US005415137A

United States Patent [19]

Paul

[11] Patent Number: 5,415,137

[45] Date of Patent: May 16, 1995

[54] VALVE ACTUATING MECHANISM FOR AN INTERNAL COMBUSTION ENGINE

[75] Inventor: Michael Paul, Bad Friedrichshall, Germany

[73] Assignee: Audi AG, Ingolstadt, Germany

[21] Appl. No.: 241,754

[22] Filed: May 12, 1994

[30] Foreign Application Priority Data

May 27, 1993 [DE] Germany ..... 43 17 638.0

[51] Int. Cl.[6] ..... F01L 1/12; F01L 1/18; F01L 1/26

[52] U.S. Cl. ..... 123/90.16; 123/90.22; 123/90.4

[58] Field of Search ..... 123/90.15, 90.16, 90.17, 123/90.22, 90.39, 90.4, 90.41, 90.44

[56] References Cited

U.S. PATENT DOCUMENTS 5,203,289 4/1993 Hara et al. ..... 123/90.16
5,297,516 3/1994 Hara ..... 123/90.16

*Primary Examiner*—Henry C. Yuen
*Assistant Examiner*—Weilun Lo
*Attorney, Agent, or Firm*—Lalos & Keegan

[57] ABSTRACT

A valve actuating mechanism for at least one inlet valve or outlet valve which can be alternatively actuated by a low rotational speed cam 2, 3 or a high rotational speed cam 7 by means of a first rocker lever 5 or a second rocker lever 9, includes a coupling pin 12, which is used for coupling the two rocker levers and which is located in a hole 10 of the first rocker lever 5 and can be displaced by a pressure medium against the action of a spring 17 towards the outside into a hole 11 in the second rocker lever 9 when the holes 10 and 11 are aligned with one another. In order to ensure that after it has been subjected to pressure, sufficient time remains for the coupling pin 12 to penetrate completely into the hole 11, a locking element 26 is provided which engages by means of a projection 29 in an annular groove 30 in the pin 12 and holds the latter in its inner position until the second rocker lever 9 presses the spring tongue 26 downwards during its lift phase—because of the motion relative to the first rocker lever 5 occurring because of its lift phase—and presses the projection 29 out of the annular space 30 so that the whole of the next base circle phase is available for the displacement of the pin 12.

4 Claims, 3 Drawing Sheets

VALVE ACTUATING MECHANISM FOR AN INTERNAL COMBUSTION ENGINE

BACKGROUND OF THE INVENTION

The invention relates to a valve actuating mechanism.

In such valve actuating mechanisms, the problem consists in the fact that when switching over, i.e. when the high rotational speed cam has to become effective by the coupling of the two rocker levers, it is not reliably possible to ensure that the coupling pin immediately penetrates completely into the hole in the second rocker lever after it has been acted on by pressure because the holes in the two rocker levers are only aligned with one another when the rocker levers are running on the base circles of their cams and because the pin requires a certain period after the pressure begins to act on it in order to pass into its coupling position. Consequently, the situation can arise in which the pin protrudes only slightly into the hole in the second rocker lever at the beginning of the lift phase resulting in a substantial surface pressure which leads to severe wear. In order to solve this problem, it is known in the art—in a differently constructed valve actuation appliance (as described in DE-C 35 26 542)—to provide a locking element which is actuated by a cam of its own and only releases the coupling pin during a lift phase of the two rocker levers so that the whole of the following base circle phase is available for the displacement of the pin. This solution for the system discussed is, however, complicated.

SUMMARY OF THE INVENTION

The object of the invention is to ensure by simple means, in a valve actuating mechanism of the generic type, that the coupling pin passes into its second end position during the coupling procedure.

In order to release the coupling pin, the proposal according to the invention uses the fact that the second rocker lever, which interacts with the high speed cam, executes a larger lift than the first rocker lever during the lift phase. If the coupling procedure is introduced by pressure acting on the coupling pin during a base circle phase, therefore, the coupling pin is initially locked by the locking element. If the lift phase of the second rocker lever now begins, the locking element is pressed out of the annular groove of the coupling pin by this second rocker lever so that the coupling pin is displaced as far as the second rocker lever but cannot penetrate into the hole in the second rocker lever because the holes in the first and the second rocker lever are no longer aligned with one another. As soon as the two rocker levers are again running on their base circles, the holes are aligned and the pin can now be completely introduced into the hole in the second rocker lever. The complete period of the base circle phase is available for this purpose. This, therefore, reliably avoids only part of the pin passing into the hole in the second rocker lever when the rocker levers run through their next lift phase.

Because, according to the invention, the release of the locking element is effected by the relative motion between the two rocker levers during the lift phase, the locking and release of the coupling pin can be carried out in a substantially simpler manner than it can in the known prior art. The locking element can, for example, be formed by a simple spring tongue which is attached to the bottom of the first rocker lever. This tongue has a projection which can be engaged in the annular groove and extends under the second rocker lever. During its lift phase, the second rocker lever presses the spring tongue downwards and therefore presses the projection out of the annular groove so that the coupling pin can now be displaced, in the manner previously described, as far as the second rocker lever and can then, during the following base circle phase, be pushed into the hole in the second rocker lever. In order to avoid increasing the dimensions of the rocker lever group and to avoid reducing the contact surface of the coupling pin in the hole in the first rocker lever, it is expedient to provide the first rocker lever with a slot through which the projection on the spring tongue extends.

BRIEF DESCRIPTION OF THE DRAWINGS

An embodiment example of the invention is described below with reference to the drawings. In these.

DETAILED DESCRIPTION OF THE PREFERRED EMBODIMENT

Figure 1:
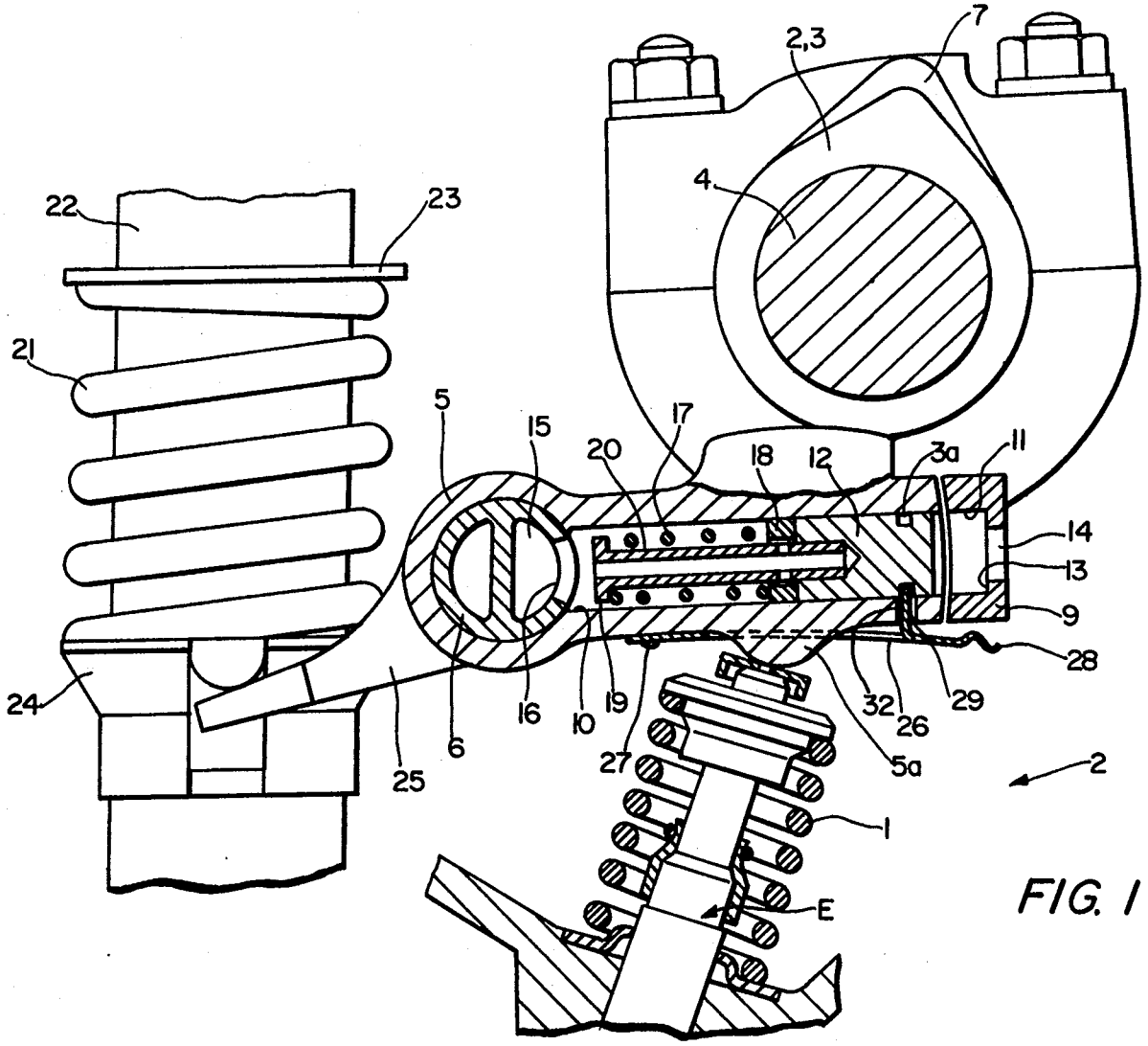
FIG. 1 shows, in a vertical section along the line 1—1 in FIG. 2, a valve drive with a valve actuation appliance according to the invention, the coupling pin being held in its decoupled position.
Figure 2:
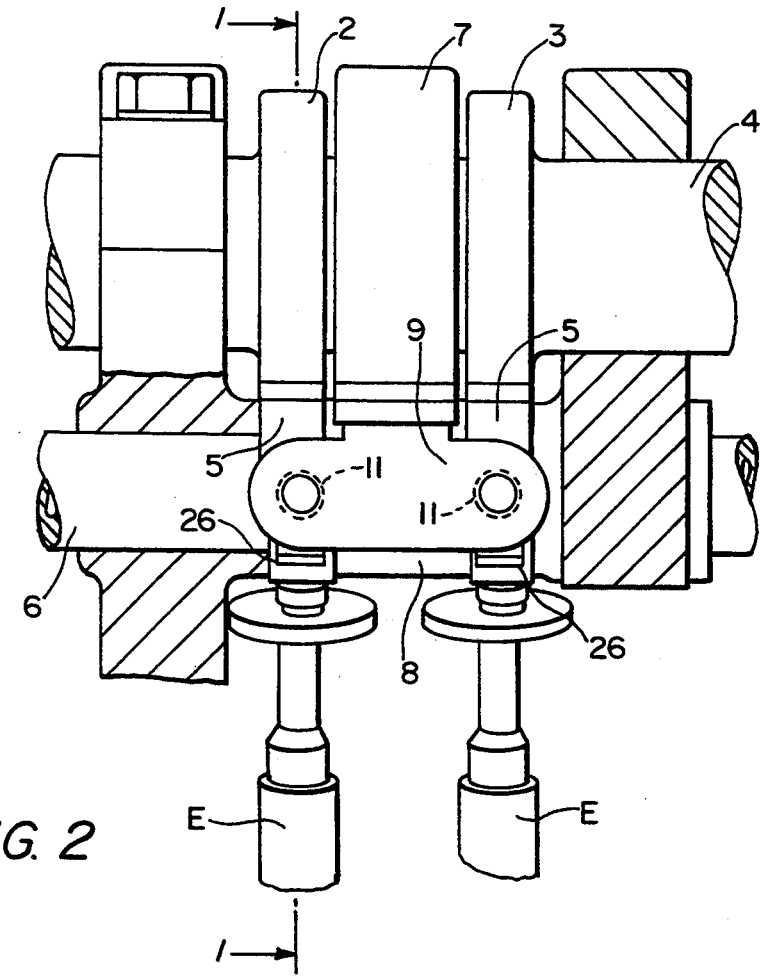
FIG. 2 shows a view in the direction of the arrow 2 in FIG. 1.

A valve drive is shown in the drawing for two inlet valves E. Each valve is acted on by a spring 1 in the closing direction. The valves are actuated by their own cams 2, 3 of a camshaft 4 via first rocker levers 5 which are pivotably supported on a common stationary pin 6. The cams 2 and 3 preferably have different cam profiles in order to achieve a different valve lift, a different opening duration and/or different control periods for the individual inlet valves and to create optimum conditions in the lower and medium rotational speed range of the internal combustion engine. A further cam 7 is arranged between the two cams 2 and 3 on the camshaft 4 and its cam profile is designed for the relationships in the upper rotational speed range of the internal combustion engine, i.e. it effects a larger valve lift and a longer opening duration. A second rocker lever 8 interacts with the cam 7 and this second rocker lever 8 can be coupled to the first rocker lever 5 in the upper rotational speed range so that the valves E are actuated in accordance with the contour of the second cam 7 in this rotational speed range. The free end of the second rocker lever 8 is provided with a tie-bar 9 which extends in front of and at a small distance from the free ends of the first rocker levers 5. Holes 10 at right angles to the pivot pin 6 are provided in the first rocker levers 5 and these holes 10 are aligned with holes 11 in the tie-bar 9 when the valves E are in their closed position, i.e. when the rocker levers 5 and 8 are running on the base circles of their cams 2, 3 and 7. A coupling pin 12 is arranged in each hole 10 and this coupling pin 12 can be displaced between a first inner position (FIG. 1) and a second outer position (FIG. 4) in which it engages in the corresponding hole 11 in the tie-bar 9. In the second position, therefore, the coupling pins 12 connect the first rocker levers 5 to the second rocker lever 8 so that the valves are actuated in accordance with the contour of the cam 7. The coupling pins 12 are then respectively located on a shoulder 13 which is formed by a ventilation hole 14 of smaller diameter adjoining the hole 11.

The displacement of the coupling pins 12 towards the outside takes place with the aid of a pressure medium which is supplied through a passage 15 in the rocker lever pin 6, the passage 15 being in connection with the holes 10 by means of openings 16 in the wall of the pin 6. If the pressure is reduced, the coupling pins 12 are respectively reintroduced into their holes 10 by a spring 17 (see FIG. 1) so that the second rocker lever 8 can now oscillate freely and the actuation of the valves takes place by means of the first rocker levers 5 in accordance with the contour of the cams 2 and 3. The spring 17 is supported, at one end, on an insert 18 fixed in the hole 10 and, at the other end, on the end 19 of a tube 20 which is fastened on the coupling pin 12 and extends through the insert 18. The insert 18 forms, at the same time, a stop for the coupling pin 12 in its inner position, as shown in FIG. 1.

Whereas the first rocker levers 5 are held in contact with their cams 2 and 3 by the valve springs 1, a spring 21 is provided for contact between the second rocker lever 8 and its cam 7. This spring 21 is arranged on a tube 22 accommodating a sparking plug or an injection valve and is supported, at one end, on a stationary abutment 23 and, at the other end, on a displaceable plate spring 24, which interacts with prolongations 25 of the second rocker lever 8, which prolongations partially surround the tube 22.

Figure 3:
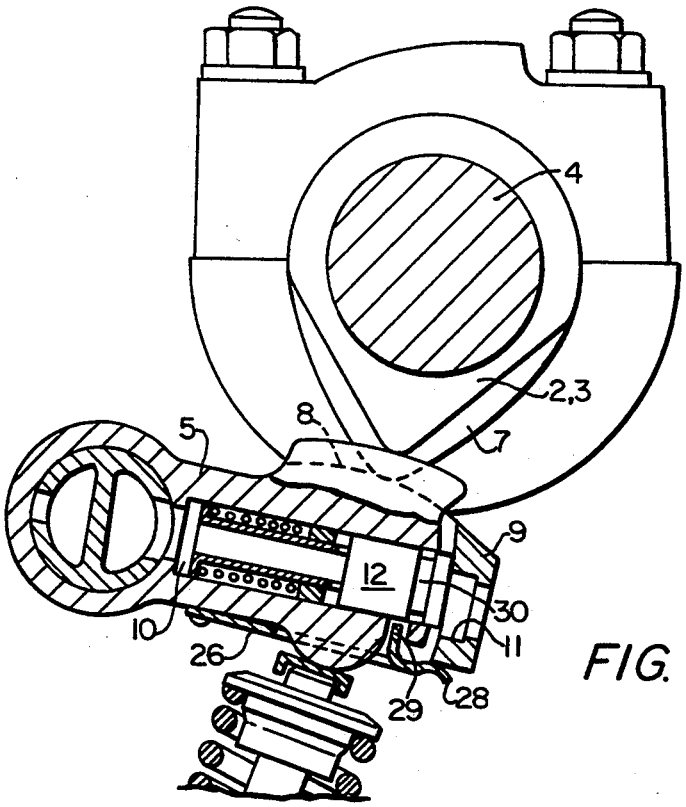
FIG. 3 shows the section in accordance with FIG. 1, the coupling pin being released after the beginning of a lift phase.
Figure 4:
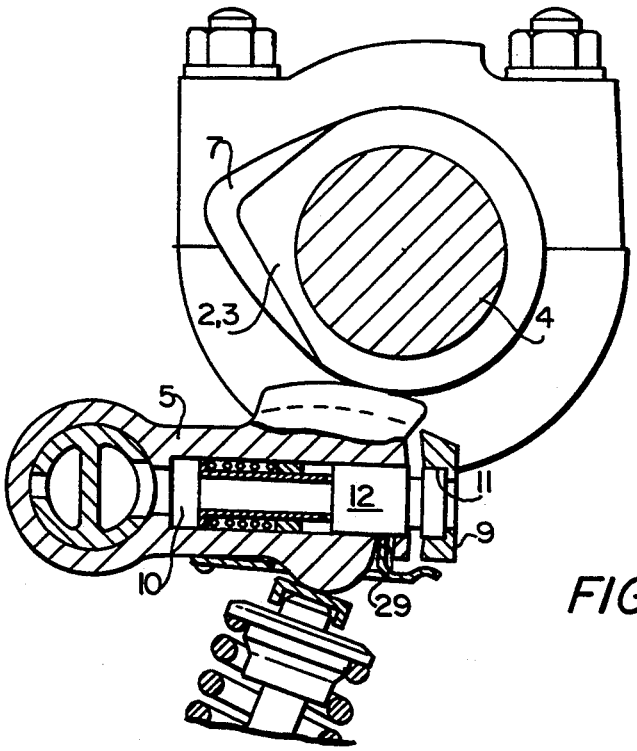
FIG. 4 shows a section corresponding to FIG. 1, a coupling pin being in its coupled position.

Coupling of the rocker levers 5 and 8 by the coupling pin 12 can only take place when the holes 10 and 11 are aligned with one another. This is the case when the rocker levers are running on the base circles of their cams 2, 3 and 7 and when the period between the moment when pressure is applied to the pin 12 and the beginning of the lift phase of the second rocker lever 8 is sufficiently long for the pin 12 to be introduced into the hole 11 as far as the stop 13. If pressure is applied to the piston 12 during the base circle phase, this period is usually too short to ensure complete immersion of the pin 12 in the hole 11. Increased surface pressure and severe wear then occurs. In order to ensure that the complete base circle phase of the second rocker lever 8 is available for the coupling procedure—which is sufficient for reliable complete introduction of the pin 12 into the hole 11—a locking appliance is provided for the pin 12. This locking appliance holds the piston 12 in the withdrawn position shown in FIG. 1 even if it is subjected to high pressure and only releases it when the second rocker lever 8 is in its lift phase. After the conclusion of the lift phase, both rocker levers 5 and 8 run on the base circles of their cams, i.e. the holes 10 and 11 are aligned with one another, and the released pin 12 can now be pushed into the hole 11. In the embodiment example, the locking mechanism consists of a spring tongue 26, which is fitted to the bottom of the first rocker lever 5 and is connected at one end to the rocker lever 5 by means, for example, of a screw 27 while its other end 28 extends under the tie-bar 9 of the second rocker lever 8. The spring tongue 26 is provided with a projection 29 which extends through a slot in the rocker lever 5 and engages in an annular groove 30 in the pin 12. This locks the pin 12 in the position shown in FIG. 1. At the beginning of the lift phase of the second rocker lever 8, the tie-bar 9 is displaced downwards relative to the first rocker lever 5 (see FIG. 3) so that it comes into contact on the end 28 of the spring tongue 26 and presses the latter downwards with the result that the projection 29 disengages from the annular groove 30. The piston 12 can now be pushed to the left in FIG. 3 by the high pressure acting on it until it comes into contact with the inner surface of the tie-bar. When the camshaft 4 is further rotated, first the rocker levers 5 and then the rocker lever 8 come into contact on the base circle of their cams 2, 3 and 7, respectively, so that the holes 10 and 11 are aligned with one another and the pin 12 can be pushed completely by the pressure applied into the hole 11 in the tie-bar 9. This is represented in FIG. 4. The projection 29 is now in contact with the outer surface of the pin 12. If the pin 12 is relieved of pressure, it will be returned by the spring 17 into its first position represented in FIG. 1 and the projection 29 can again engage in the annular groove 30.

Figure 5:
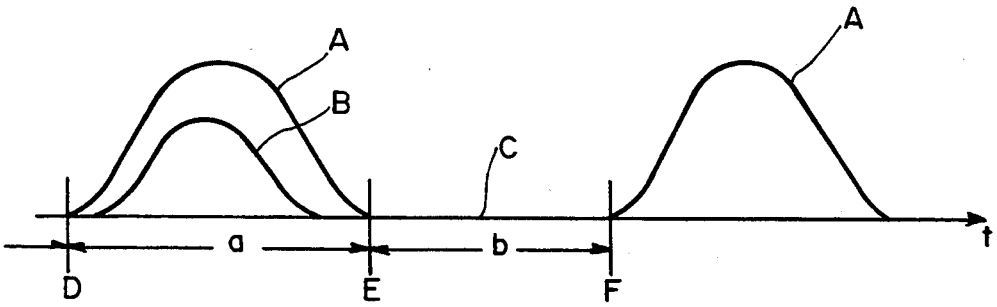
FIG. 5 shows a perspective representation of the locking element.

The spring tongue 26 is shown in perspective in FIG. 5. It has an opening 31 through which extends the projection 5*a* of the rocker lever 5, which projection acts on the valve 1.

Figure 6:
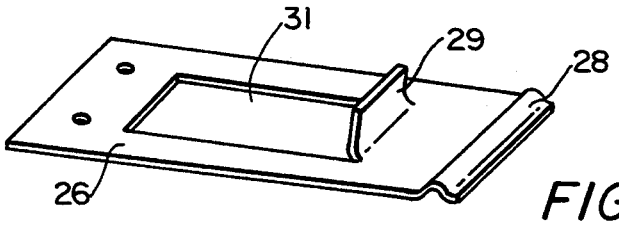
FIG. 6 shows a graphical representation of the valve actuation cycle, plotted against time.

The course of the coupling procedure described above and represented in FIG. 1, 3 and 4 is explained again using the diagram of FIG. 6. In this, the lift curve of the high rotational speed cam 7 is indicated by A, the lift curve of the low rotational speed cams 2 and 3 is indicated by B and the base circle phase of the high rotational speed cam 7 is indicated by C.

It is assumed that during the base circle phase of the high rotational speed cam 7, the pin 12 is subjected to high pressure before, i.e. to the left of, the point D. Up to the point D, the pin 12 is locked as shown in FIG. 1. At the beginning of the lift phase A of the high rotational speed cam 7, the second rocker lever 8, with its tie-bar 9, is displaced in accordance with FIG. 3, so that the pin 12 is released; until the second rocker lever 8 is again running on the base circle of its cam, which is the case at the point E. The condition shown in FIG. 3 is therefore present during the period a. At the point E, the condition in accordance with FIG. 4 is reached, i.e. the holes 10 and 11 are aligned with one another, and the pin 12 has until the time F, at which the next lift phase A of the second rocker lever 8 begins (i.e. during the whole of the base circle phase C), to pass into the hole 11 in the tie-bar 9. This period is indicated by b in FIG. 5. The rocker levers 5 and 8 now move jointly in accordance with the contour of the high rotational speed cam 7 and the valves are actuated in accordance with this contour.

The invention is not limited to the embodiment example presented. As an example, a pivotable locking element, which engages in sprung manner in the groove 30 and is pressed out of the groove 30 by the second rocker lever 8 during its lift phase and which is equivalent to the spring tongue 26, could be arranged on the pivot pin 6 between the second rocker lever 8 and the first rocker levers 5. It would also be fundamentally possible to dispense with the groove 30 and to permit the projection 29 of the spring tongue 26 to interact with the right-hand end (in FIG. 1) of the pin 12. Finally, the invention cannot be used only for a valve actuating mechanism for two inlet valves or outlet valves per cylinder but can be likewise used for one inlet valve or outlet valve or more than two inlet valves or outlet valves per cylinder, which valves can be optionally actuated by different cams via rocker levers.

I claim:

1. A valve actuating mechanism for a multi-cylinder internal combustion engine including at least one inlet valve or outlet valve per cylinder, the valve actuating mechanism comprising:

a camshaft which, for each valve, has a first cam for a lower rotational speed range and a second cam for an upper rotational speed range;

a first rocker lever per valve interacting with the first cam;

a second rocker lever interacting with the second cam;

a coupling device between each of the first rocker levers and the second rocker levers and including a coupling pin, the first and second rocker levers including holes which are aligned with one another when the first and second rocker levers are running on the base circles of their cams, the coupling pin being located exclusively in the hole in the first rocker lever and being able to be brought by pressure acting on it into a second end position against the force of a spring, in which end position it protrudes into the hole in the second rocker lever and connects the two rocker levers together; and a pivotable locking element for each coupling pin, wherein the pivotable locking element is held in its locked position by spring force and is brought out of engagement with the coupling pin by the second rocker lever when the latter is running on the protuberance of its cam.

2. A valve actuating mechanism according to claim 1, wherein the coupling pin includes an annular groove and the locking element includes a projection which engages in the annular groove.

3. A valve actuating mechanism according to claim 2, wherein the locking element is formed by a spring tongue attached to the bottom of the first rocker lever and extending under the second rocker lever.

4. A valve actuating mechanism according to claim 3, wherein the first rocker lever includes a slot through which the locking element projection extends.

* * * * *